US007096597B1

(12) United States Patent
Zellous

(10) Patent No.: US 7,096,597 B1
(45) Date of Patent: Aug. 29, 2006

(54) BACKPACK HAIR DRYER WITH HEATED AIR BONNET

(76) Inventor: Alicia Zellous, 5903 Danny Kaye, #1004, San Antonio, TX (US) 78227

( * ) Notice: Subject to any disclaimer, the term of this patent is extended or adjusted under 35 U.S.C. 154(b) by 0 days.

(21) Appl. No.: 10/762,417

(22) Filed: Jan. 22, 2004

Related U.S. Application Data

(60) Provisional application No. 60/441,926, filed on Jan. 22, 2003.

(51) Int. Cl.
*F26B 19/00* (2006.01)

(52) U.S. Cl. ..... 34/90

(58) Field of Classification Search ..... 34/96, 34/97, 99, 101, 90; 392/380, 383; 132/212; 224/153
See application file for complete search history.

(56) References Cited

U.S. PATENT DOCUMENTS 3,377,715 A * 4/1968 Hubner ..... 34/99
3,946,498 A * 3/1976 Waters et al. ..... 34/99
5,651,190 A * 7/1997 Sanders ..... 34/99
6,038,783 A * 3/2000 McFadden ..... 34/99

* cited by examiner

*Primary Examiner*—Kenneth Rinehart
(74) *Attorney, Agent, or Firm*—Kenneth L Tolar

(57) ABSTRACT

A backpack type hair dryer with a heated air bonnet includes a housing having a pair of shoulder straps positioned on a front surface for securing the housing to a wearer's back. A hot air blower assembly is mounted on the rear surface of the housing. A flexible hose is connected to the blower assembly and includes a wearable head bonnet at a distal end. Accordingly, a user can dry his or her hair while simultaneously wandering and performing other tasks.

14 Claims, 2 Drawing Sheets

BACKPACK HAIR DRYER WITH HEATED AIR BONNET

CROSS REFERENCE TO RELATED APPLICATIONS

This application is entitled to the benefit under 35 U.S.C § 119(e) of provisional application No. 60/441,926 filed on Jan. 22, 2003.

BACKGROUND OF THE INVENTION

1. Technical Field of the Invention

The present invention relates to a portable, backpack type hair dryer that allows a user to meander while the dryer is in use so that other tasks can be performed simultaneously therewith.

2. Description of the Prior Art

Most people have busy schedules and are constantly trying to maximize their available time. Few chores waste more time than hair drying, particularly as it pertains to women, or those with long hair. Many conventional hair dryers include a bonnet that rests on or immediately above the head allowing a user to read or perform similar tasks while seated. However, because the user must remain seated in order for the hair to be dried, the type of tasks that he or she can perform is limited. Accordingly, there is currently a need for a portable device that would allow a user to meander while his or her hair is being dried, allowing the user to simultaneously perform a broader range of tasks.

The present invention addresses this need by providing a backpack style hair dryer that allows a user to freely wander while the dryer is operating. Furthermore, the device includes a wearable bonnet that frees the user's hands to perform other tasks.

SUMMARY OF THE INVENTION

The present invention relates to a backpack type hair dryer with a heated air bonnet that includes a portable housing having a front surface, a rear surface, a top edge, a lower edge and two opposing side edges. Disposed on the rear surface is a squirrel cage type blower having an air outlet positioned thereon. Within the blower is an air passageway having a heating element disposed therein for generating heated air. The blower and heater are powered with rechargeable batteries received within one or more pockets on the housing.

An elongated flexible hose includes two ends, a first of which is fastened to the blower outlet. The other end has a bonnet attached thereto. The bonnet includes a head receiving cavity with a plurality of air discharge apertures disposed on the interior surface thereof. Accordingly, the blower and heater are activated to deliver hot air to the head receiving cavity thereby drying a wearer's hair.

Secured to the front surface of the housing are a pair of shoulder straps allowing a user to wear the device like a conventional backpack. The housing front surface further includes a pouch accessible via an opening on an edge thereof. A freezable pad is removably received within the pouch for protecting the wearer's back from burns that could be caused by the heater or blower.

It is therefore an object of the present invention to provide a hair dryer that can be worn on a user's back allowing a user to freely move about while the dryer is in use.

It is another object of the present invention to provide a portable hair dryer that includes a wearable bonnet thereby freeing the user's hands for other tasks.

It is yet another object of the present invention to provide a backpack type hair dryer that includes a protective barrier for preventing the hot air blower assembly from burning a wearer.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
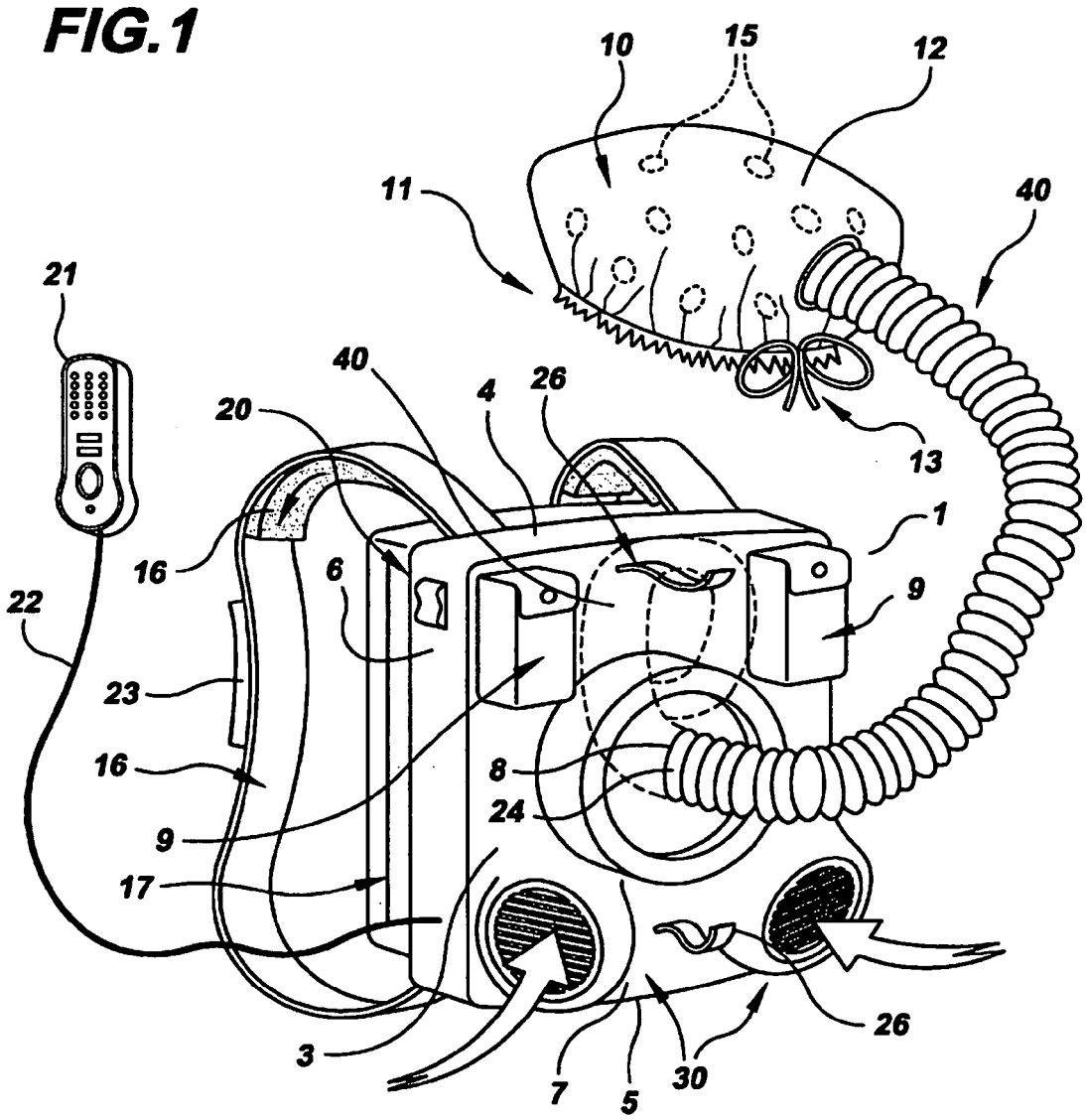
FIG. 1 is a perspective view of an exemplary embodiment of the backpack hair dryer with heated air bonnet according to the present invention.
Figure 2:
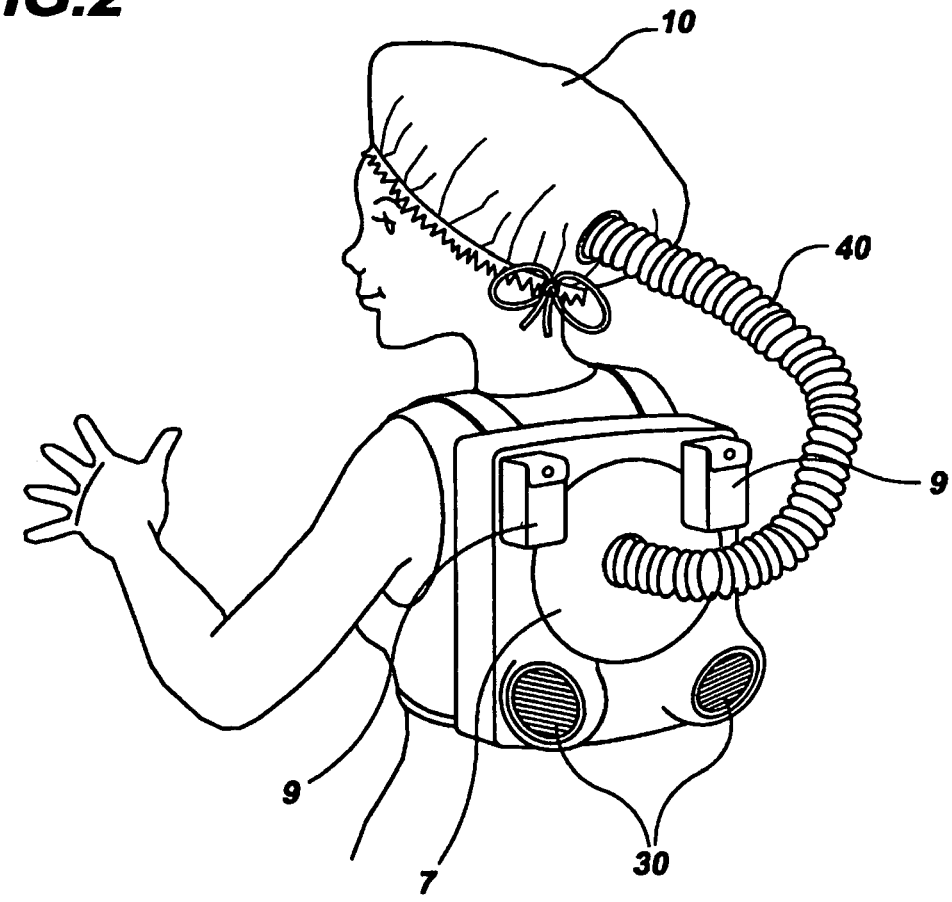
FIG. 2 is a perspective view showing the freezable protective pad and its corresponding holding pouch.
Figure 3:
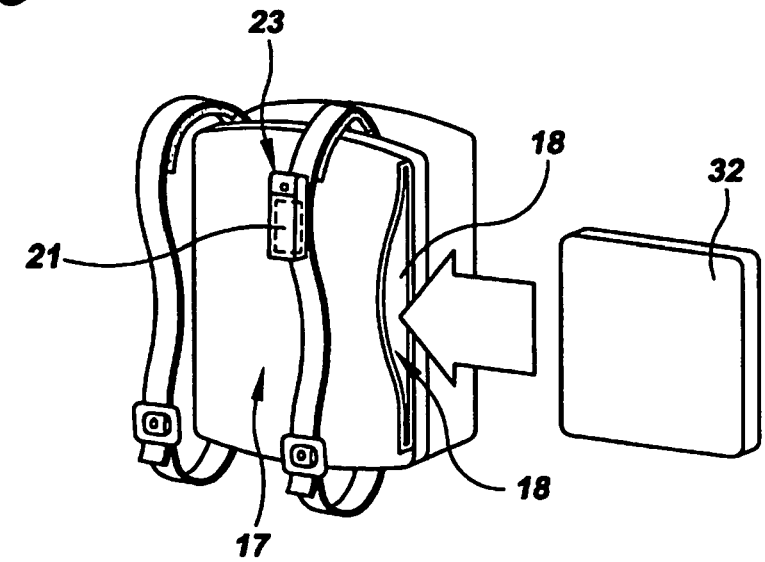
FIG. 3 is a perspective view of the backpack hair dryer being worn by a user.

Referring now to FIGS. 1–3, the present invention relates to a backpack type hair dryer with a heated air bonnet that includes a portable housing 1 having a front surface 2, a rear surface 3, a top edge 4, a lower edge 5 and two opposing side edges 6. Disposed on the rear surface is a squirrel cage type hot air blower 7 having an air outlet 8 positioned thereon. Within the blower is an air passageway having a heating element disposed therein for heating air flowing through the passageway. A pair of air intake vents 30 are positioned on the rear surface of the housing, preferably adjacent the lower edge thereof, for supplying fresh ambient air to the blower. The blower and heater are powered with rechargeable batteries received within a pair of pockets 9 on the housing rear surface.

The hair dryer also includes an elongated flexible air hose 40 having two opposing ends, a first of which includes a coupling member 24 for removable, mating engagement with the blower outlet. The opposing end has a bonnet 10 attached thereto. The bonnet includes an elastomeric, expandible opening 11 in communication with a head receiving cavity 12. The opening 11 includes a peripheral drawstring 13 that allows a user to vary the size of the opening according to the size of a wearer's head. The head receiving cavity includes an interior surface with a plurality of air discharge apertures 15 disposed thereon that are in communication with the hose. Accordingly, when the blower and heater are activated, hot air is delivered to the cavity apertures to dry a wearer's hair. A pair of bands 26 having hook and loop fasteners thereon are attached to the rear surface of the housing for securing the hose in a coiled configuration when not in use.

Secured to the front surface of the housing are a pair of padded, adjustable shoulder straps 16 allowing a user to wear the device like a conventional backpack. The housing front surface further includes a pouch 17 accessible via an opening 18 on an edge thereof that removably receives a freezable pad 32. When the device is being properly worn, the frozen pad is positioned between the wearer's back and the hot air blower assembly thereby protecting the back from burns that may be caused by the heater or blower.

Operation of the heater and blower is generally controlled with a switch 20 conveniently positioned on the housing. Additionally, operation is controlled with a remote device 21 electrically connected to the heater and blower with a cable 22. A remote receiving pocket 23 is positioned on one of the shoulder straps for storing the remote when not in use. The remote may also include a timer control for controlling operating duration and a heat intensity adjustment for selectively varying the temperature of air delivered to the bonnet.

As is now readily apparent, the present invention provides a portable, backpack type hair dryer that allows a user to conveniently perform other tasks while the device is being used. The above described device is not to be limited to the exact details of construction and enumeration of parts provided above. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A backpack hair dryer comprising:

a housing having a front surface and a rear surface;

a hot air blower assembly positioned on the rear surface of said housing, said blower assembly having an air outlet;

a pair of shoulder straps secured to the front surface of said housing;

an air hose having two ends, one of said ends connected to the blower assembly outlet;

a bonnet attached to the other of said ends of said hose, said bonnet including a head receiving cavity having a plurality of air discharge apertures positioned thereon, said apertures in communication with said hose allowing hot air to be delivered from said blower to a user's head when said bonnet is placed thereover to dry the user's hair;

a pouch positioned on the front surface of said housing;

a pad removably received within said pouch, said pad having a freezable solution disposed therein whereby said pad is frozen and is placed within said pouch so that when said housing is properly worn, the pad is positioned between a wearer's back and the blower assembly providing a cool, protective barrier therebetween.

2. The hair dryer according to claim 1 further comprising a pair of air intake vents positioned on the rear surface of said housing for supplying fresh ambient air to said blower assembly.

3. The hair dryer according to claim 1 further comprising a remote control means for remotely controlling operation of said hot air blower assembly.

4. The hair dryer according to claim 3 further comprising a pocket on one of said shoulder straps for removably receiving said remote means when said remote means is not in use.

5. The hair dryer according to claim 1 further comprising at least one band on the rear surface of said housing for securing said hose in a coiled configuration when said hose is not in use.

6. A backpack hair dryer comprising:

a housing having a front surface and a rear surface;

a hot air blower assembly positioned on the rear surface of said housing, said blower assembly having an air outlet;

a pair of shoulder straps secured to the front surface of said housing;

an air hose having two ends, one of said ends connected to the blower assembly outlet;

a bonnet attached to the other of said ends of said hose, said bonnet including a head receiving cavity having a plurality of air discharge apertures positioned thereon, said apertures in communication with said hose allowing hot air to be delivered from said blower to a user's head when said bonnet is placed thereover to dry the user's hair;

a remote control means for remotely controlling operation of said hot air blower assembly;

a pocket on one of said shoulder straps for removably receiving said remote means when said remote means is not in use.

7. The hair dryer according to claim 6 further comprising:

a pouch positioned on the front surface of said housing;

a pad removably received within said pouch, said pad having a freezable solution disposed therein whereby said pad is frozen and is placed within said pouch so that when said housing is properly worn, the pad is positioned between a wearer's back and the blower assembly providing a cool, protective barrier therebetween.

8. The hair dryer according to claim 6 further comprising a pair of air intake vents positioned on the rear surface of said housing for supplying fresh ambient air to said blower assembly.

9. The hair dryer according to claim 6 further comprising at least one band on the rear surface of said housing for securing said hose in a coiled configuration when said hose is not in use.

10. A backpack hair dryer comprising:

a housing having a front surface and a rear surface;

a hot air blower assembly positioned on the rear surface of said housing, said blower assembly having an air outlet;

a pair of shoulder straps secured to the front surface of said housing;

an air hose having two ends, one of said ends connected to the blower assembly outlet;

a bonnet attached to the other of said ends of said hose, said bonnet including a head receiving cavity having a plurality of air discharge apertures positioned thereon, said apertures in communication with said hose allowing hot air to be delivered from said blower to a user's head when said bonnet is placed thereover to dry the user's hair;

at least one band on the rear surface of said housing for securing said hose in a coiled configuration when said hose is not in use.

11. The hair dryer according to claim 10 further comprising:

a pouch positioned on the front surface of said housing;

a pad removably received within said pouch, said pad having a freezable solution disposed therein whereby said pad is frozen and is placed within said pouch so that when said housing is properly worn, the pad is positioned between a wearer's back and the blower assembly providing a cool, protective barrier therebetween.

12. The hair dryer according to claim 10 further comprising a pair of air intake vents positioned on the rear surface of said housing for supplying fresh ambient air to said blower assembly.

13. The hair dryer according to claim 10 further comprising a remote control means for remotely controlling operation of said hot air blower assembly.

14. The hair dryer according to claim 13 further comprising a pocket on one of said shoulder straps for removably receiving said remote means when said remote means is not in use.

* * * * *